US007431353B1

(12) United States Patent
Huston

(10) Patent No.: US 7,431,353 B1
(45) Date of Patent: Oct. 7, 2008

(54) SUICIDE DOOR LATCH

(75) Inventor: Fred M. Huston, Simi Valley, CA (US)

(73) Assignee: 50's Boy, Inc., Simi Valley, CA (US)

( * ) Notice: Subject to any disclaimer, the term of this patent is extended or adjusted under 35 U.S.C. 154(b) by 0 days.

(21) Appl. No.: 11/779,190

(22) Filed: Jul. 17, 2007

Related U.S. Application Data

(60) Provisional application No. 60/890,431, filed on Feb. 16, 2007.

(51) Int. Cl.
*E05C 5/02* (2006.01)

(52) U.S. Cl. ..... 292/57; 292/58

(58) Field of Classification Search ..... 292/57–64, 292/67

See application file for complete search history.

(56) References Cited

U.S. PATENT DOCUMENTS 267,539 A * 11/1882 Johnson ..... 292/58
549,924 A * 11/1895 Brown ..... 292/58
849,800 A * 4/1907 Lowtherp ..... 292/244
901,511 A * 10/1908 Winn ..... 292/71
1,731,680 A * 10/1929 Mueller ..... 292/67
4,012,063 A * 3/1977 Sherlock et al. ..... 292/57
4,198,082 A * 4/1980 Imhoff ..... 292/67
5,280,973 A * 1/1994 Culling ..... 292/58
6,003,908 A * 12/1999 King ..... 292/61
6,866,309 B1 * 3/2005 Marks ..... 292/57

* cited by examiner

*Primary Examiner*—Gary Estremsky
(74) *Attorney, Agent, or Firm*—Rob L. Phillips; Greenberg Traurig

(57) ABSTRACT

Described is a latch assembly that can be mounted within a door structure or in an adjacent frame structure of a vehicle to secure a suicide-type car door to an adjacent door panel. The latch assembly includes first and second blocks mounted adjacent and spaced from one another. A rod is actuatable between the two blocks by a user. Locking mechanisms allow the rod to be secured in a desired position.

10 Claims, 4 Drawing Sheets

SUICIDE DOOR LATCH

CROSS-REFERENCE TO RELATED APPLICATION

This application claims the benefit of U.S. Provisional Application No. 60/890,431 filed Feb. 16, 2007, which is incorporated herein by reference in its entirety for all purposes.

FIELD OF THE INVENTION

The embodiments of the present invention relate to door accessories and kits, more specifically, to a latch assembly that is particularly useful in a suicide-type door to secure the door to an adjacent door panel.

BACKGROUND

Custom cars such as hot rods, muscle cars, old time cars and the like are very popular throughout the United States and other parts of the world. Such custom cars may be constructed and built from kits or may be stock cars that were manufactured by the well-known automotive car companies (e.g., Ford). Many custom cars (e.g., 1967 Ford Thunderbird) employ what is referred to as "suicide" doors. A suicide door is a car door that is hinged about the rear edge, i.e., the edge closer to the rear of the vehicle. Accordingly, a suicide door opens by swinging the door from front to back. Suicide doors may also be installed on vehicles which were not manufactured with them in place. In other words, suicide doors may be installed as an aftermarket product on vehicles. There is, however, a safety concern with respect to suicide doors opening if they inadvertently become unlatched while the car is moving.

Thus, there exists a need for an effective door locking mechanism that can be easily installed and operated to maintain the doors of cars in a secure and locked position when desired.

SUMMARY

Accordingly, a first embodiment of the present invention discloses a latch assembly comprising: a first block having a first aperture therethrough; a second block having a second aperture, said first and second block adapted to be mounted to a vehicle; and a rod held by said first block and actuatable through the first aperture in the first block and received by the second aperture in the second block. The blocks include countersunk holes for receiving fastening means such as screws and rivets to facilitate securing the blocks to portions of a car. The rod can further include grooves, slots and a ball handle to facilitate actuation of the rod through the apertures. In other embodiments, the latch assembly further includes one or more spacers.

Other variations, embodiments and features of the present invention will become evident from the following detailed description, drawings and claims.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
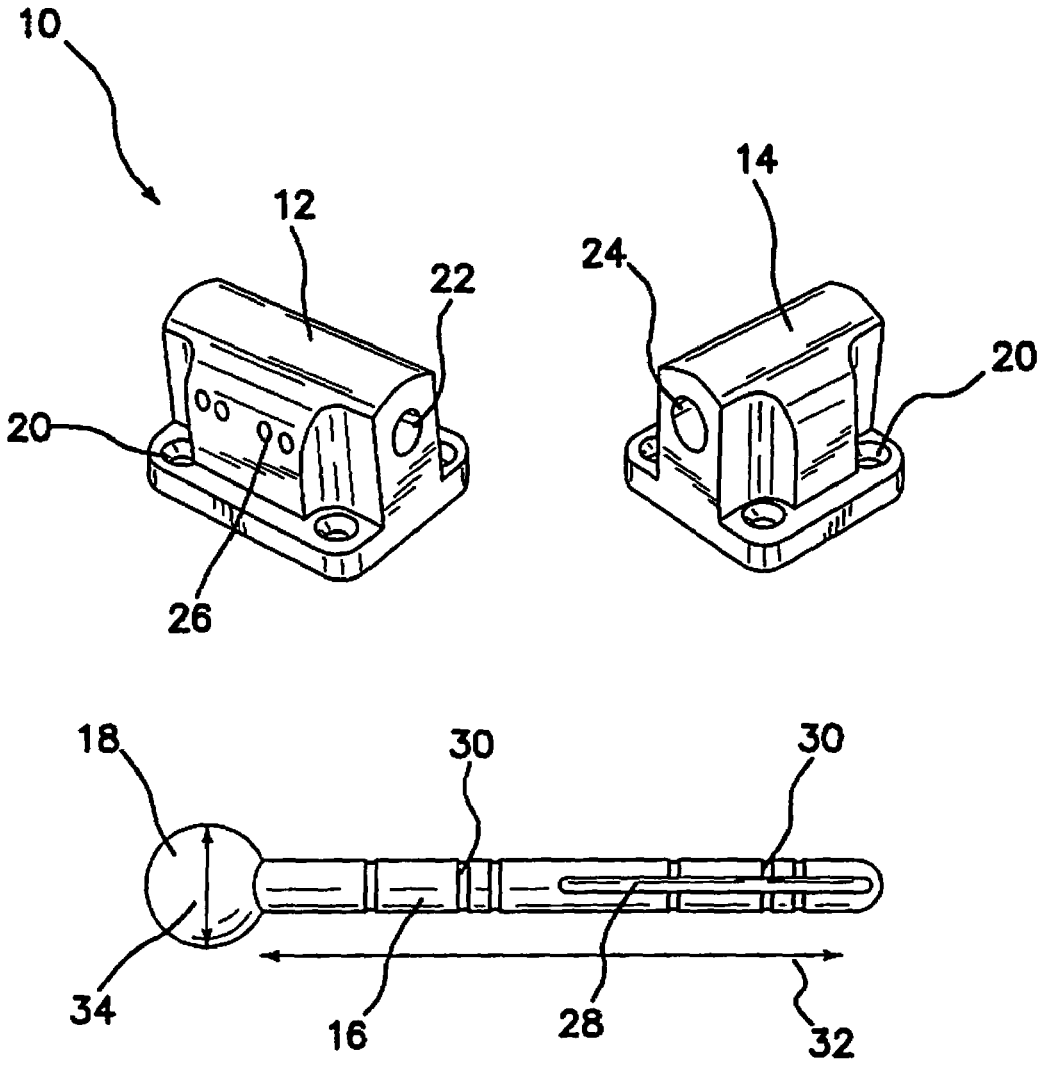
FIG. 1 illustrates perspective views of various components of a suicide door latch assembly according to the presently disclosed invention.

Initial reference is made to FIG. 1 illustrating the various components of a suicide door latch assembly 10 according to the embodiments of the presently disclosed invention. The latch assembly 10 includes a securing block 12, a receiver block 14 and a shaft or rod 16 that is partially received by a ball handle 18. Ideally, each of the components 12, 14, 16, 18 are constructed of stainless steel. Alternatively, the components 12, 14, 16, 18 can be made of aluminum, brass, metal or other suitable materials.

Both the securing block 12 and receiver block 14 include a plurality of countersunk holes 20 disposed about the edges of the blocks 12, 14 for receiving various fastening means such as screws and rivets (not shown). Ideally, the blocks 12, 14 can be mounted to a door, door frame, door jamb, door post or other suitable locations on the subject car (not shown). In the alternative, instead of using screws or rivets, the blocks 12, 14 can be integrated or permanently attached, using an adhesive or similar means, to the car door or door panel.

The securing block 12 includes an aperture 22 therethrough for receiving the rod 16 with the aperture 22 sized to accommodate the diameter of the shaft 16. In one embodiment, the aperture 22 is open at both ends of the securing block 12 and extends the entire length of the securing block 12. Likewise, the receiver block 14 also includes an aperture 24 sized to accommodate the diameter of the rod 16. The receiver block 14 can, but need not, extend the entire length of the receiver block 14 because the receiver block 14 need not receive the entire length 32 of the rod 16. In other words, while the entire length 32 of the rod 16 can be received by the securing block 12 via aperture 22 therethrough, the aperture 24 of the receiver block 14 need only receive a portion of the rod 16.

The securing block 12 further includes a plurality of ball plungers 26 for providing spring-like action as they make contact with the rod 16 as the rod 16 is actuated through the aperture 22 of the securing block 12. This becomes more evident in subsequent figures and discussion. Although ball plungers 26 are described, it will be understood by those skilled in the art that spring plungers and other plunger-like accessories may be used. Furthermore, although four ball plungers 26 are illustrated, there can be more or fewer means of actuating the rod 16 as necessary.

As described earlier, the rod 16 can include a ball handle 18 or other type of handle means for facilitating actuation of the rod 16. In one embodiment, the ball handle 18 has a spherical diameter 34 of about 2 cm. However, the ball handle 18 may be any shape and size, as desired, to facilitate movement and actuation of the rod 16. The rod 16 further includes a plurality of circumferential grooves 30 spaced longitudinally along the rod 16. The grooves 30 being spaced correspondingly to the spacing of the plurality of ball plungers 26 on the securing block 12 for reasons which become more evident in subsequent figures and discussion. In one embodiment, the rod 16 has a length 32 of about 10 cm, but can be shorter or longer depending on the distance between the blocks 12, 14 after they are mounted on the vehicle. The rod 16 also includes an elongated slot 28 disposed along the rod 16. As with the grooves 30, the ball plungers 26 may engage the longitudinal slit 28 to facilitate movement and actuation of the rod 16.

Figure 2:
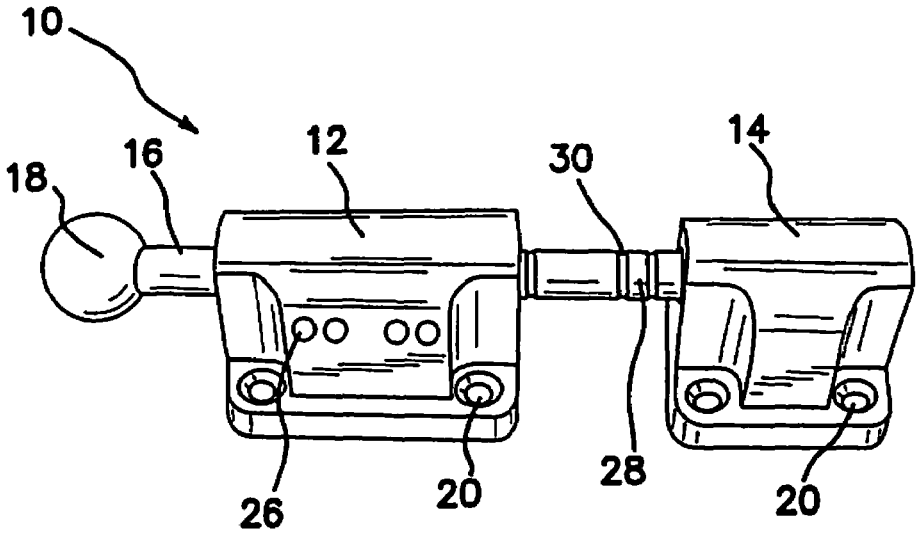
FIGS. 2-3 illustrate perspective and schematic views of the suicide door latch assembly in a secure and locked position, respectively.
Figure 4:
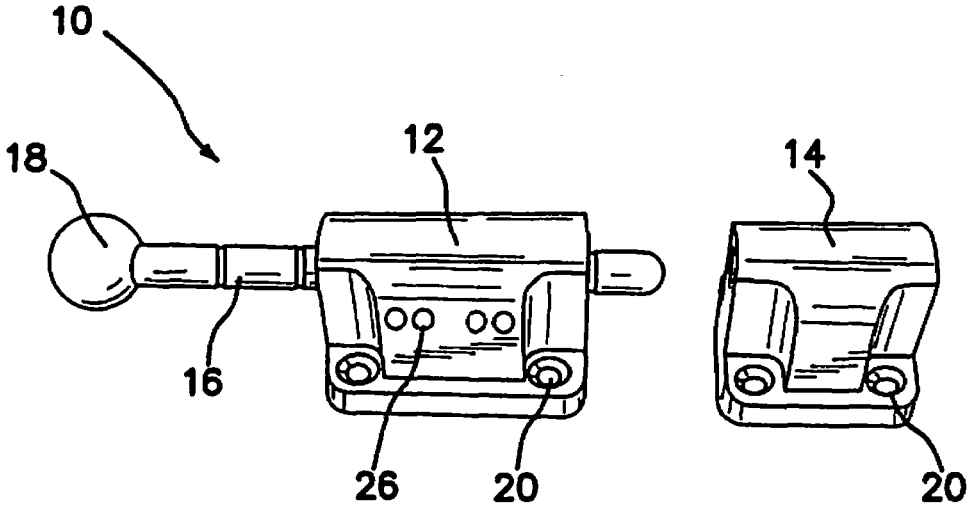
FIGS. 4-5 illustrate perspective and schematic views of the suicide door latch assembly in an open and disengaged position, respectively.
Figure 3:
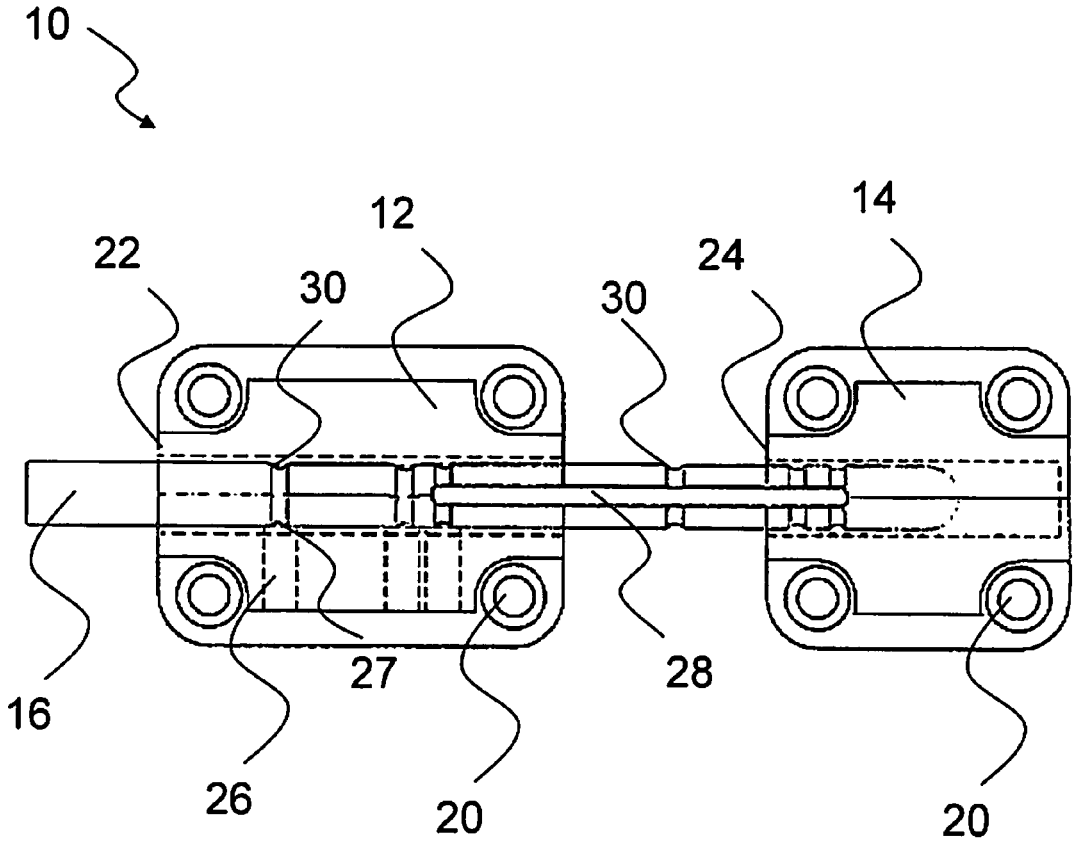
Figure 5:
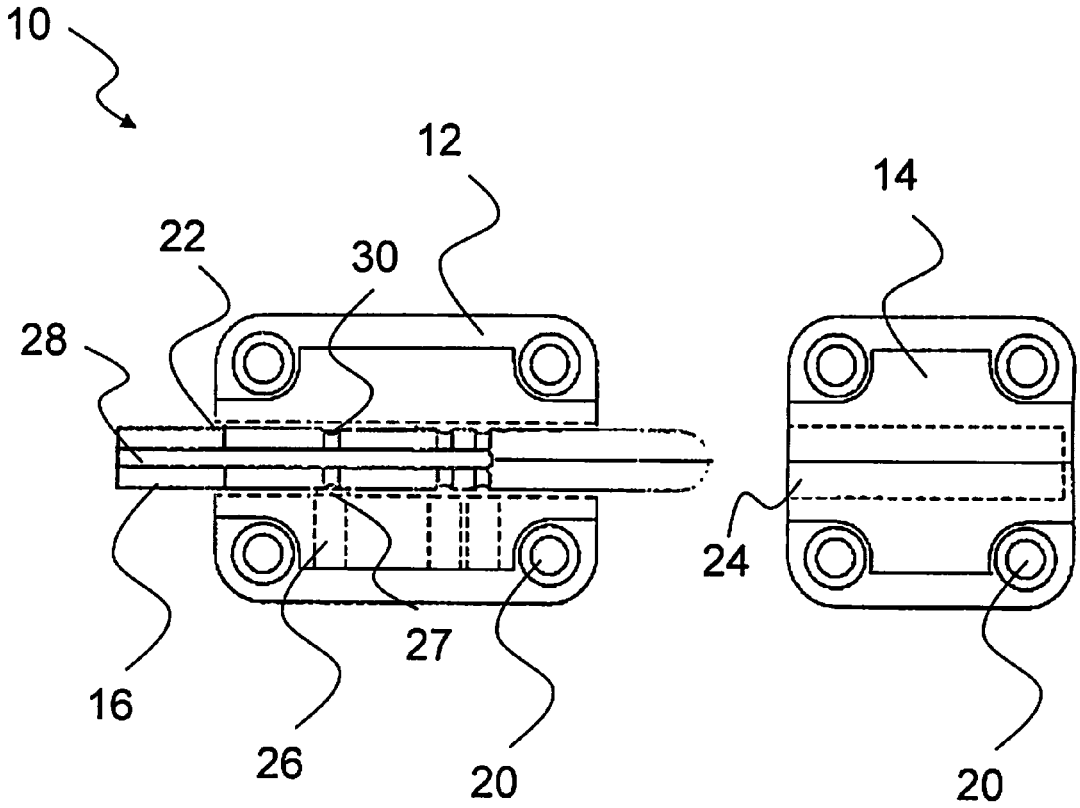

FIGS. 2-5 illustrate the suicide door latch assembly 10 in a mounted arrangement. Preferably, the securing block 12 is physically mounted to a car door frame, door jamb or door post using screws inserted through the countersunk holes 20 and the receiver block 14 is physically mounted to a car door using screws inserted through the countersunk holes 20. In a secure and locked position as shown in FIGS. 2 and 3, the rod 16 engages both securing block 12 and receiver block 14 thereby maintaining the car door in a closed position preventing it from opening accidentally or intentionally. In an open and disengaged position as shown in FIGS. 4 and 5, the rod 16 engages only the securing block 12 but not the receiver block 14 thereby allowing the car door to be opened and closed without interference from the rod 16 or the blocks 12, 14.

Reference is now made to FIGS. 2 and 3 illustrating perspective and schematic views, respectively, of the door latch assembly 10 in a secure and locked position. As shown in FIGS. 2 and 3, the rod 16 extends the entire length of the securing block 12 via the aperture 22 and is partially received within the aperture 24 of the receiver block 14. In addition, the ball plungers 26 within the securing block 12 operably engage the circumferential grooves 30 of the rod 16 as best shown in the schematic of FIG. 3. In this secured and locked position, the ball plungers 26 exert sufficient pressure against the grooves 30 such that the rod 16 does not intentionally or unintentionally slip out of the blocks 12, 14. Ideally, each ball plunger 26 includes a spring-biased element 27 that is directed toward the interior of the aperture 22 for engaging with the recess of the groove 30. In doing so, the ball plunger 26 ensures that the rod 16 does not freely move about the blocks 12, 14. As such, in the secure and locked position, the car door is safely secured to an adjacent door panel and cannot be readily opened.

Reference is now made to FIGS. 4 and 5 illustrating perspective and schematic views, respectively, of the door latch assembly 10 in an open and disengaged position. As shown in FIGS. 4 and 5, the rod 16 extends the entire length of the securing block 12 via the aperture 22 but does not engage any portion of the receiver block 14. To toggle between the secure and locked position (FIGS. 2-3) and the open and disengaged position (FIGS. 4-5), a user pushes or pulls on the ball handle 18 facilitating actuation of the rod 16 in and out of the apertures 22, 24. At times, the user may have to rotate the ball handle 18 to align the slot 28 with the ball plungers 26. Like with the grooves 30, the ball plungers 26 can also operably engage the slot 28 to facilitate in the actuation of the rod 16. In one embodiment, both the grooves 30 and the slot 28 function to prevent the rod 16 from intentionally or unintentionally moving about the blocks 12, 14. When the ball plungers 26 engage the circumferential grooves 30, there is longitudinal resistance since the grooves 30 are lateral to the rod 16. By aligning the ball plungers 26 with the slot 28, the pressure exerted by the spring-biased elements 27 are reduced in the longitudinal direction, i.e., about the length 32 of the rod 16. Therefore, the rod 16 can be more readily toggled and freely moved about the blocks 12, 14. In other instances, the slot 28 may not be necessary and the door latch assembly 10 can function sufficiently with the ball plungers 26 and the grooves 30.

Although a ball handle 18 has been shown to facilitate actuation of the rod 16 between the secure and locked position (FIGS. 2-3) and the open and disengaged position (FIGS. 4-5), one skilled in the art will appreciate that the rod 16 can be actuated or driven electronically by implementing a push button in place of the ball handle 18 by incorporating additional electronic components (not shown). Other known manual or electronic actuation elements may also be incorporated instead of the ball handle 18. In some instances, the ball handle 18 may not be necessary and the rod 16 can be actuated by pushing or pulling any portion of the rod 16.

Figure 6:
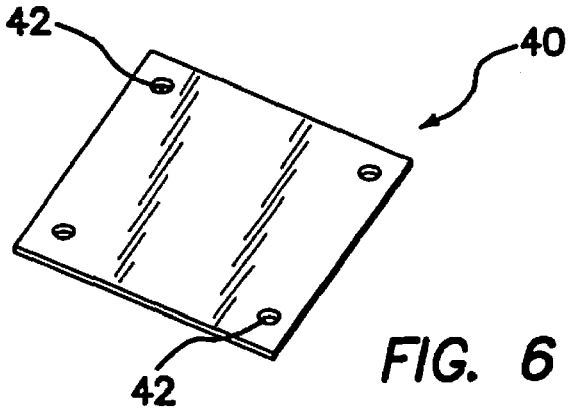
FIG. 6 illustrates a spacer for aligning the blocks of the suicide door latch assembly.

When the rod 16 is received by the securing block 12, it may have a limited range of motion because it is securely received within the aperture 22 and the ball springs 26 operably engage the grooves 30 and slot 28. Therefore, since it has limited range of motion, there may be potential misalignment if there are substantial height differences between the car door and the car door panel when the blocks 12, 14 are mounted to the vehicle. Therefore, one or more spacers 40 may employed as illustrated in FIG. 6 for aligning the blocks 12, 14 to one other. The spacers 40 are coupled to the blocks 12, 14 and mounted to the car. The spacers 40 include a plurality of slots 42 for aligning the spacers 40 with the slots 20 of the blocks 12, 14. The spacers 40 can be constructed of stainless steel or aluminum and can come in a variety of shapes, sizes and thicknesses. In one embodiment, a spacer 40 is employed to minimize any offsets in terms of alignment of the rod 16 through the apertures 22, 24 of the blocks 12, 14 by adding height to either block 12, 14 thereby allowing the rod 16 to align smoothly within the apertures 22, 24. It is appreciated that more than one spacers 40 may be utilized within the door latch assembly 10.

Although the invention has been described in detail with reference to several embodiments, additional variations and modifications exist within the scope and spirit of the invention as described and defined in the following claims.

I claim:

1. A latch assembly comprising:

a first block having a first aperture therethrough;

a second block having a second aperture, said first and second block adapted to be mounted to a vehicle; and a rod held by said first block and actuatable through the first aperture in the first block and received by the second aperture in the second block, said rod having one or more circumferential grooves adapted to engage one or more ball actuators integrated within the first or second block, said rod further having one or more longitudinal grooves wherein said longitudinal grooves intersect one or more of said circumferential grooves.

2. The assembly of claim 1, further comprising a ball handle attached to the rod.

3. The assembly of claim 1, further comprising one or more spacers for coupling to the two blocks.

4. The assembly of claim 1, wherein each of the two blocks includes at least one opening for receiving a fastening means.

5. A latch assembly comprising:

a first block having a first aperture therethrough;

a second block having a second aperture, said first and second block adapted to be mounted to a vehicle; and a rod having a ball handle on end thereof, said rod held by said first block and actuatable through the first aperture in the first block and received by the second aperture in the second block, said rod having one or more circumferential grooves adapted to engage one or more ball actuators integrated within the first or second block, said rod further having one or more longitudinal grooves wherein said longitudinal grooves intersect one or more of said circumferential grooves.

6. The assembly of claim 5, further comprising one or more spacers for coupling to the two blocks.

7. The assembly of claim 5, wherein each of the two blocks includes at least one opening for receiving a fastening means.

8. A latch assembly comprising:

a first block having a first aperture therethrough and at least one ball plunger;

a second block having a second aperture, said first and second block adapted to be mounted to a vehicle; and a rod having a ball handle on one end thereof and at least one groove therein, said rod held by said first block and actuatable through the first aperture in the first block and received by the second aperture in the second block, said at least one circumferential groove adapted to engage the at least one ball plunger, said rod further having one or more longitudinal grooves wherein said longitudinal grooves intersect one or more of said circumferential grooves.

9. The assembly of claim 8, further comprising one or more spacers for coupling to the two blocks.

10. The assembly of claim 8, wherein each of the two blocks includes at least one opening for receiving a fastening means.

* * * * *